United States Patent [19]

Corder, Jr.

[11] Patent Number: 4,892,317

[45] Date of Patent: Jan. 9, 1990

[54] GOLF CLUB SWING TRAINING DEVICE

[76] Inventor: William O. Corder, Jr., 1003 Windwood Dr., Anderson, S.C. 29621

[21] Appl. No.: 218,279

[22] Filed: Jul. 13, 1988

[51] Int. Cl.[4] ..... A63B 69/36

[52] U.S. Cl. ..... 273/183 B; 273/189 R

[58] Field of Search ..... 273/183 B, 189 R, DIG. 30, 273/183 R, 29 A, 26 C, 54 B, 186 R

[56] References Cited

U.S. PATENT DOCUMENTS

| | | | |
|---|---|---|---|
| 4,058,852 | 11/1977 | Aragona | 273/183 B X |
| 4,377,284 | 3/1983 | Okerlin | 273/189 R |
| 4,691,924 | 9/1987 | Strong | 273/189 R |

*Primary Examiner*—George J. Marlo

*Attorney, Agent, or Firm*—Cort Flint

[57] ABSTRACT

A releasable golf swing training connector (A) is disclosed which includes a chest strap (10) for encircling a chest (12) of a golfer and an arm strap (14) for encircling an upper arm (13) of the golfer. A connector strap (18) connects the chest and arm straps to hold the arm close to the body and properly restrict it during the back and forward swings of a golf stroke. A releasable connector (B) forms a releasable connection between the chest and arm straps. Velcro connectors (C) provide a releasable connector which releases partially and produces a discernible audible signal when the swing deviates by a first amount and completely releases to disconnect the connection should the golfer's swing exceed still further the prescribed swing avoiding physical injury while teaching muscle memory to the golfer.

11 Claims, 2 Drawing Sheets

GOLF CLUB SWING TRAINING DEVICE

BACKGROUND OF THE INVENTION

The invention relates to a training device for training a golfer to swing a club in a correct golf swing movement. More particularly, the invention relates to a training device for restricting the golf swing movement of the arm relative to the golfer's body and for releasing should the golf swing movement be excessive.

The relationship between a golfer's leading arm and the body during the golf swing requires that the golf swing movement be in a correct arc and plane if a good golf shot is produced. In particular, it is desired that the leading arm be held close to the body during the backswing and during the follow-througn.

Numerous devices have been proposed for training the golfer to have the correct golf swing with the leading arm held close to the golfer's body in a properly connected relationship with the golfer's body. For example, U.S. Pat. No. 3,970,316 discloses a golf swing restrictor which includes an elastic chest band and an elastic arm band which are joined together by stitching at an acute angle. U.S. Pat. No. 4,691,924 discloses a similar training device for restricting movement which includes a combination elastic/inelastic chest band and an inelastic arm band joined together by an inelastic web. This is different in that the chest and arm bands are not sewn together as in the '316 patent. In addition, various improvements are said to be offered by the training device. However, in both these prior devices the chest band and arm band are rigidly connected together. Other golf swing training devices are shown in U.S. Pat. Nos. 3,679,214; 2,808,267; and 2,093,153. These devices also consist of various arrangements of bands which fit across the upper torso of the golfer's body and a portion of the golfer's arm to restrict the arm movement relative to the upper torso of the body to train the golfer for a correct golf swing.

In all of the above training devices, the bands which encircle the upper torso of the golfer's body and arm are connected together in a rigid fashion. While the intended purpose is to restrict the movement of the golfer's arm during the golf swing, the force of the golf swing is often quite large. The rigid affixiation of the various bands about the torso and arm of the golfer's body can lead to physical injury if the forces and restrictions are large enough. More importantly, however, is the psychological damage done by the rigid affixiation of straps as the golfer swings the club under force. In a sense, the golfer becomes, "gun shy" after having physically felt the restriction severe enough a few times to cause physical discomfort. It is also felt that the rigidly affixed band arrangements of the prior art are only restrictive devices and are really not training devices in the true sense of the word. That is, the golfer may swing the golf club properly during the golf swing if the training device is worn about the body. However, once the restrictive device is removed from the body, there is no longer any restriction and the golfer returns to an incorrect swing. This is because it is thought that the restrictive type devices are not, in reality, training the golfer in the true sense of the word. There is not mental muscle control established by the restrictive devices but only a restrictive function is provided.

Accordingly, an important object of the invention is to provide a training device for training a golfer to have a correct golf swing which avoids physical injury to the golfer.

Another object of the invention is to provide a training device for training a golfer to have a correct golf swing in which muscle memory is learned and not just golf swing restriction.

Another object of the invention is to provide the training device worn by the golfer which restricts the golfer to a correct golfer, yet releases should the golfer's golf swing exceed the normal and correct movement for the golf swing.

Another object of the invention is to provide a releasable golf swing training device which is worn about the chest and swing arm of the golfer which has a first release position in which a discernible noise is produced should the golfer begin to exceed the normal golf swing movement and thereafter releases completely should the force of the golf swing continue to exceed the correct swing.

SUMMARY OF THE INVENTION

The above objectives are accomplished according to the present invention by a golf swing training connector which includes a chest strap for encircling the chest of a golfer, an arm strap for encircling an upper arm of the golfer, and a connector strap connecting the chest and arm straps. A releasable connector forms a connection between the connector strap and the chest and arm straps which releases due to the force of the backswing. The releasable connector produces a discernible audible signal when the golfer deviates from the desired backswing movement by a first amount causing the connector to partially release for muscle memory mentally training the golfer to maintain his backswing to within the desired backswing movement. The releasable connector releases to completely disconnect the connection between the chest and arm straps when the golfer's backswing movement deviates from the desired backswing movement by a second amount greater than the first amount to prevent injury to the golfer.

In a preferred form, the releasable connector includes a first connector piece carried on the chest strap and a second connector piece carried on the arm strap. The connector strap includes a third connector piece carried on a first end and a fourth connector piece carried on a second end. The first and third connector pieces form a first releasable connector, and the second and fourth connector pieces form a second releasable connector. One end of the connector strap may be permanently attached to a chest or arm strap with only one releasable connector provided at the other end to the other strap.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 4A is a perspective of an alternate embodiment of a releasable golf swing training connector constructed according to the invention;

FIG. 4B is a perspective of an alternate embodiment of a releasable golf swing training connector constructed according to the invention;

DESCRIPTION OF A PREFERRED EMBODIMENT

Referring now in more detail to the drawings, a golf swing connector training device is illustrated which is designated generally as A. The training device comprises a chest strap 10 for encircling an upper torso or chest 12 of a golfer; and an arm strap 14 for encircling an upper arm 16 of the golfer. In accordance with the invention, a releasable connector means, designated generally as B, is illustrated for releasably connecting the chest and arm straps releasing only in the event of an extreme overswing on the backswing to prevent muscle or other physical injury. Since the golfer can swing knowing that no physical injury or pain will be encountered, there is a reduced psychological fear in using the connector device. Concentration may be had on reproducing a correct golf swing without the distraction normally accompanying the anticipation of an injurious or painful event.

Figure 1:
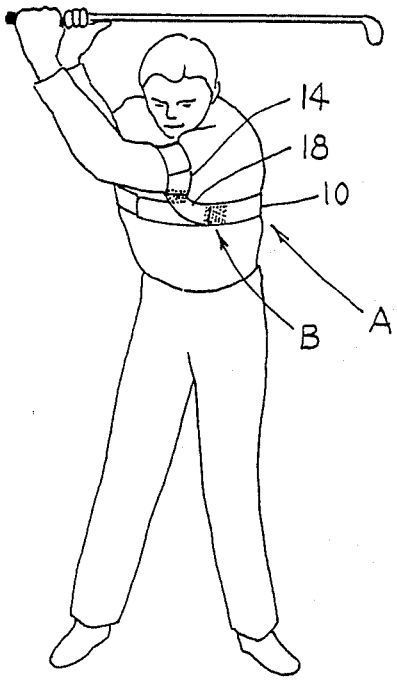
FIG. 1 is a perspective view illustrating a golfer fitted with a releasable golf swing training connector constructed according to the invention undergoing a backswing of a golf swing.
Figure 2:
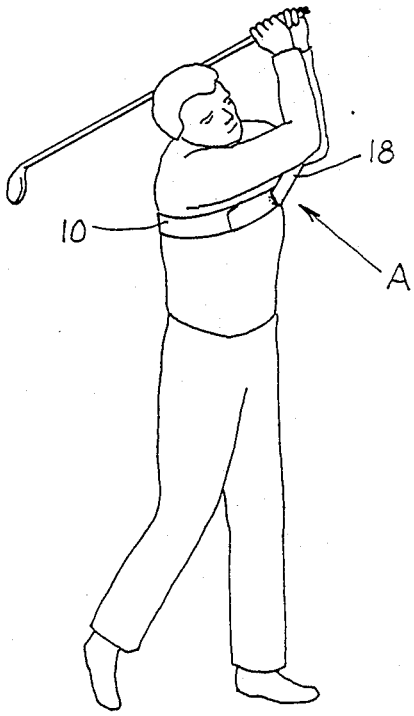
FIG. 2 is a perspective view of a golfer wearing a releasable golf swing training connector constructed according to the invention in a follow-through of the golf swing.
Figure 3:
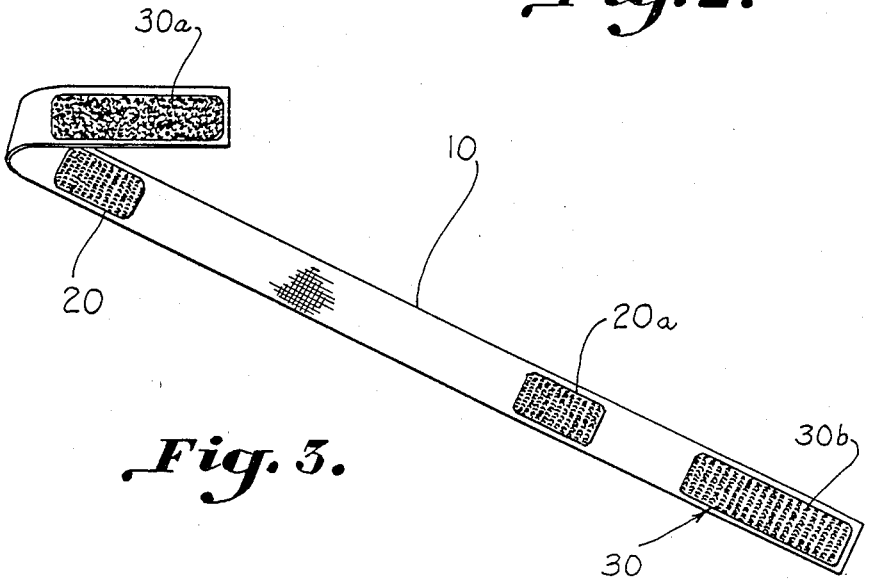
FIG. 3 is a perspective view of a chest strap of a releasable golf swing training connector according to the invention.
Figure 4:
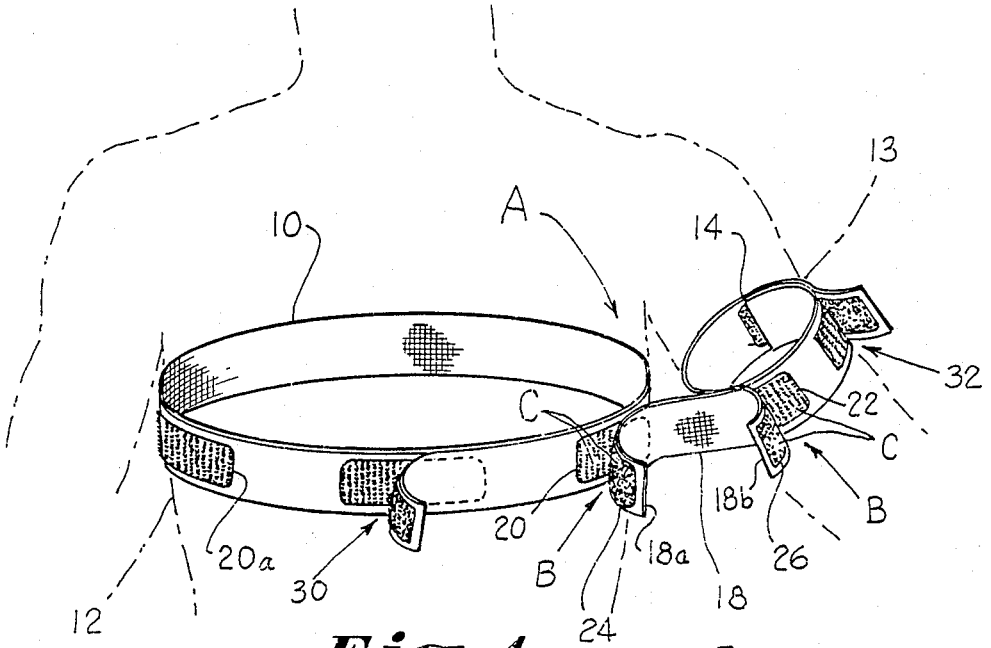
FIG. 4 is a front elevation illustrating a person wearing a releasable golf swing training connector constructed in accordance with the invention.
Figure 5:
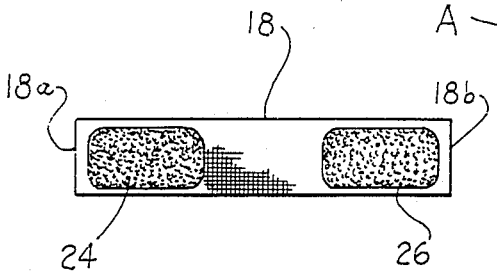
FIG. 5 is a front elevation of a connector strap for a releasable golf swing training connector according to the invention.
Figure 6:
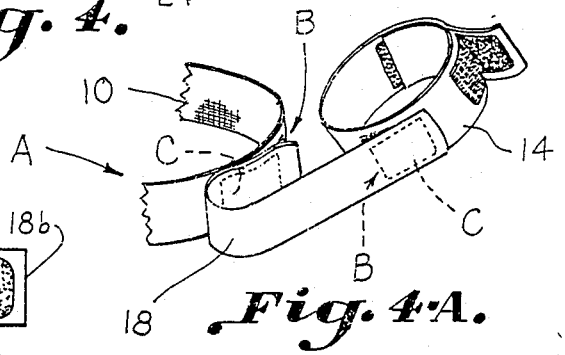
FIG. 6 is an elevation of an arm strap for a releasable golf swing training connector according to the invention.
Figure 6:
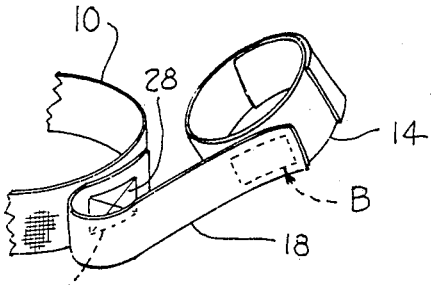
Figure 6:
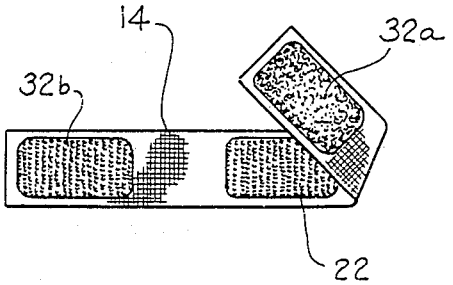

As can best be seen in FIGS. 4 and 4A, releasable connector means B includes a connector strap 18 for connecting chest strap 10 and arm strap 14 for restricting and connecting the golfer's leading arm 16 to a desired backswing movement during a golf swing. A releasable Velcro connector means C is provided for connecting connector strap 18 and at least one of the chest and arm straps due to the force of the backswing. One end of connector strap 18 may be sewn to one of the chest and arm straps and the releasable Velcro connector means is carried by the other end of the connector strap and the other of the chest and arm straps. Alternately, the connector strap may be two pieces, each having an end sewn to one of the chest and arm straps with the free ends of the strap being joined together by the releasable Velcro connector. Velcro is preferred as a connector because of its releasable features which have been found to provide desirable results in application to a golf swing training connector. The releasable Velcro connectors means produces a discernible audible signal when the golfer deviates, i.e. overswings or disconnects the arm from its proper position relative to the upper torso, from the desired backswing movement by a first amount causing the connector means to partially release for mentally training the golfer to maintain his backswing to within the desired backswing movement, and the releasable Velcro connector means releases to completely disconnect the connector strap from the one strap when the golfer's backswing movement deviates from the desired backswing movement by a second amount greater than the first amount to prevent injury to the golfer.

As can best be seen in FIGS. 4 and 4A, releasable Velcro connector means C includes a first Velcro connector piece 20 carried on chest strap 10 and a second Velcro connector piece 22 carried on arm strap 14. The connector strap includes a third Velcro connector piece 24 carried on a first end **18*a* and a fourth Velcro connector piece 26 carried on a second end 18*b* of connector strap 18. First and third Velcro connector pieces form a first releasable Velcro connector means, and second and fourth Velcro connector pieces forming a second releasable Velcro connector means. In FIG. 4B, one end 18*a* of strap 18 is affixed to chest strap 10 by any suitable means such as sewing at 28 and connected at end 18*b* to arm strap 14 by a releasable connector B. Of course, either end 18*a*, 18*b*** may be affixed and the other provided with releasable coupling B. It will be noted that Velcro provides several expedients in the invention. It releases in steps, produces an audible warning and training sound, and adjusts the length of the connector for different golfers and swings. Two releasable connectors (i.e. both ends) or one may be used. A double releasable connection affords greater adjustability in the connector length and releasability.

Preferably, chest strap 10 and arm strap 14 are elastic for comfort and adjustability where connector strap 18 is inelastic to provide a connector which gives only at the releasable connector. Chest strap 10 and arm strap 14 include Velcro fasteners 30,32 for fastening the straps around the chest and arm respectively. Fasteners 30, 32 include Velcro loop and hook pieces **30*a*, 30*b* and 32*a*, 32*b***.

Preferably, releasable Velcro connector means B includes left and right Velcro connector pieces carried on opposite sides of the chest strap and a Velcro mating piece carried on an end of the connector strap for forming a releasable connection with either of the left and right Velcro connector pieces so that the arm strap may be interchangeably attached to the left arm and right arm of the golfer.

In the embodiment of FIG. 4, the Velcro pieces of the Velcro connector peel from each other when the swing exceeds the desired movement to provide a discernible audible signal for memory training of the muscles to train for a correct golf swing, and release quickly. In FIG. 4A Velcro pieces 24 and 26 are on opposite sides of connector strap 18 instead of the same side as in FIG. 4. This provides a more uniform straight line pull on the releasable connector or connectors and release.

While a preferred embodiment of the invention has been described using specific terms, such description is for illustrative purposes only, and it is to be understood that changes and variations may be made without departing from the spirit or scope of the following claims.

What is claimed is:

1. A golf swing training device comprising:

a chest strap for encircling the chest of a golfer;

an arm strap for encircling an upper arm of the golfer;

a first piece carried on an exterior of said chest strap near an armpit of said golfer;

a second piece carried by the exterior of said arm strap generally near said armpit and facing said first piece;

a connector strap for interconnecting said chest and arm straps;

a third piece carried by a first end of said arm strap mating with said first piece to form a first connection;

a fourth piece carried by a second end of said connector strap mating with said second piece carried by said arm strap to form a second connection;

at least one of said first and second connections being a releasable connection which releases when the swing of said golfer's arm exceeds a desired movement to prevent injury to said golfer; and said pieces of said releasable connection include hook and loop pieces which tear from each other when said swing exceeds said desired movement to provide a discernible audible signal for memory training of the muscles to train for a correct golf swing.

2. The device of claim 1 wherein said chest and arm straps are elastic.

3. The device of claim 2 wherein said connector strap is inelastic.

4. The device of claim 3 wherein said chest and arm straps include attachments for attaching said straps to the chest and arm respectively.

5. The device of claim 1 wherein said first piece is included on opposing sides of said chest strap near the left and right arm of said golfer so that said arm and connector straps may be interchangeably attached to either the left arm or right arm of said golfer.

6. A golf swing training connector comprising:

a chest strap for encircling the chest of a golfer;

an arm strap for encircling an upper arm of said golfer;

a connector strap connecting said chest and arm straps;

releasable connector means for releasing the connection of said connector strap between said chest and arm straps due to the force of said backswing, said releasable connector means releasing to completely disconnect said connection between said chest and arm straps when said golfer's backswing movement deviates from said desired backswing movement by a second amount greater than said first amount to prevent injury to said golfer; and a first end of said connector strap is affixed to one of said chest and arm straps and the opposite end of said connector strap is connected by said releasable connector means to the other of said chest and arm straps.

7. The device of claim 6 wherein said releasable connector means releases partially when said golfer deviates from said golf swing an amount less than the amount necessary to completely disconnect said connection and producing an audible signal for mentally training said golfer to maintain his backswing to within said desired backswing movement.

8. The device of claim 6 wherein said releasable connector means connects at least one end of said connector strap to at least one of said arm and chest straps.

9. The device of claim 6 wherein said chest strap and said arm strap are elastic, and said connector strap is inelastic.

10. The device of claim 6 wherein said chest strap and said arm strap include connector attachments for securing said straps around said chest and arm respectively.

11. The device of claim 6 wherein said releasable connector means includes left and right connector pieces carried on opposite sides of said chest strap and a connector mating piece carried on an end of said connector strap for forming a releasable connection with either of said left and right connector pieces so that said arm strap may be interchangeably attached to the left arm and right arm of said golfer.

* * * * *